US005154379A

United States Patent [19]

Parish

[11] Patent Number: 5,154,379

[45] Date of Patent: Oct. 13, 1992

[54] DETACHABLE IRON CADDY

[76] Inventor: Dorothy J. Parish, 8327 Woodhurst, St. Louis, Mo. 63134

[21] Appl. No.: 712,674

[22] Filed: Jun. 10, 1991

[51] Int. Cl.[5] ..... D06F 75/40

[52] U.S. Cl. ..... 248/117.6; 248/175; 248/499

[58] Field of Search ..... 248/117.1, 117.2, 117.3, 248/117.4, 117.5, 117.6, 117.7, 505, 499, 175, 309.1; 38/96, 107, 142

[56] References Cited

U.S. PATENT DOCUMENTS

| | | | |
|---|---|---|---|
| 1,549,954 | 8/1925 | Ball | 38/96 |
| 2,936,992 | 5/1960 | Browning | 248/499 |
| 3,054,588 | 9/1962 | Ondrasik | 248/175 X |
| 3,128,022 | 4/1964 | Mastrud, Jr. | 248/175 X |
| 3,550,888 | 12/1970 | Lehrman | 248/175 X |
| 3,729,778 | 5/1973 | McGrath | 248/499 X |
| 4,368,863 | 1/1983 | Gentile | 248/117.7 |
| 4,657,213 | 4/1987 | Hartlage | 248/117.7 |

*Primary Examiner*—Ramon O. Ramirez
*Attorney, Agent, or Firm*—Edward R. Weber

[57] ABSTRACT

A detachable iron support suitable for use with an ironing board, table or the like comprising a frame, a plurality of support members and a belt attachment assembly. The frame is shaped correlatively to the face plate of an iron and the support members are shaped such that each support member has a straight segment located between two leg segments. Each straight segment has a centrally located depression. The frame and support members are mated at a position along the leg segments opposite the ends of the leg segments so that the frame is located above the straight segment and depression thereby creating an enclosure. The belt attachment assembly is comprised of a strap, a plurality of shaped plates and a fastening means. The mated frame and support members are attached to the belt attachment assembly by placing the depressions of the straight segments of the support members between the shaped plates and strap and affixing the shaped plates and strap by either permanent or semi-permanent means. The iron support is then attached to the ironing board, table or the like by fastening the strap around the board, table, etc.

10 Claims, 2 Drawing Sheets

DETACHABLE IRON CADDY

FIELD OF THE INVENTION

The present invention relates to supports for flat irons or the like, and more particularly, to supports which have removable means for securing the supports during use to an ironing board, table or the like. The novel device is simply constructed which allows the device to be both lightweight and durable, economical to manufacture, conveniently stored and easily attached or removed from the ironing board, table or other surface.

BACKGROUND OF THE INVENTION

In the past, tailors, dressmakers, drycleaners, housewives and other individuals who require use of a hot iron in the course of their duties have faced the problem of resting the iron during use in a location which is convenient, secure, and which minimizes the dangers of burns either to the piece work or to themselves. Those who are familiar with the process of ironing flat fabrics will appreciate that a particular concern is the need to have the iron in a convenient location close at hand so that the ironing can be done with a minimum of lifting and moving of the hot iron. Another concern is the need for a secure location to prevent the hot iron from being inadvertently knocked off the ironing board or turned over. A further concern is the need to reduce the dangers associated with burning of the piece work or the individual using the hot iron.

Various supports for flat irons have been devised to facilitate storing the instrument during use. However, problems have oftentimes been encountered with these devices. Several of the support devices utilize a clamping member which is manually adjusted to the ironing board by a grip which is threaded. Such a grip is then turned to secure the support to the ironing board or table. As will be appreciated, individuals who have arthritis in their hands or do not have strong hands encounter difficulty with such devices. In other cases, the devices are heavy and cumbersome due to the materials of manufacture. As the reader will understand, use of such a support will be an unpleasant experience since the user will be reluctant to use the device at all.

It is therefore an object of the present invention to provide a support which can be attached to an ironing board, table or the like at any location convenient for the user. It is another object of the present invention to provide a support which is easily attached or removed from the ironing board or table. It is a further object of the present invention to provide a support which is lightweight yet durable. It is an additional object of the invention to provide a support which is economical to manufacture. It is a final object of the present invention to provide a support which will allow the heat from the iron to be spread across the face of the ironing surface to reduce "hot spots" and burning. Other objects and features will be in part apparent and in part pointed out hereinafter.

The invention accordingly comprises the product hereinafter described, the scope of the invention being indicated in the following claims.

SUMMARY OF THE INVENTION

The present invention is attached to conventional ironing boards, tables or other surfaces to allow a flat iron to rest conveniently and safely during use. It is simple in construction requiring a frame, two shaped support members, and a belt attachment assembly. The device may be constructed of numerous known materials which are capable of withstanding the temperatures associated with a heated flat iron.

The frame consists of a heavy gauge wire shaped to correspond with the typical shape of a flat iron and in a particular embodiment may be covered with a heat resistant material, such as Teflon. The frame is then mated with the shaped support members so that the frame will act as a flange to securely hold the flat iron in place.

The support members likewise are formed from a heavy gauge wire to which a heat resistant material may be applied and are shaped such that each member has a straight section located between two support sections. The straight section is sized such that the straight sections of two support members will create a platform on which the flat iron may rest. The support members mate with the frame at a location higher than the platform and in spaced relationship so that a stable, level resting surface is provided for the flat iron. The straight section of each support member is depressed at a central location so as to provide an attachment point for the belt attachment assembly at a position lower than the platform.

The belt attachment assembly consists of a strap, a mating tab and a fastening means and is affixed to the depressed section of each of the support members. The strap is of sufficient length to surround the ironing board, table or other surface and has a fastening means at one end. The mating tab is affixed to the strap at a location which allows the belt attachment assembly to be easily and conveniently placed around the ironing board or table and secured by the fastening means. In a particular embodiment, the mating tab will allow the belt attachment assembly to be detachably secured to the support members.

As was stated, in a particular embodiment the belt attachment assembly can be detachably affixed to the support members. This can be effected by mating a support tab assembly affixed to the depressed section of the support members and a mating tab affixed to the belt attachment assembly. The support tab assembly is constructed of known stock which may be covered with a heat resistant material and consists of a shaped plate and a mating tab. The depressed section of a support member is centered between the shaped plate and mating tab which are then joined by any of a number of known means. An embodiment shown indicates a rivet, but other means could easily be substituted. As earlier described, the support member and support tab assembly are mated at a location lower than the platform on which the flat iron rests.

The surface of the mating tabs of the support member and the belt attachment assembly may be of any of a number of known materials. In a particular embodiment, the surface may be hook and loop, commonly known as Velcro, and permitting the two tabs to detachably mate yet impervious to the heat of the hot iron when the iron is placed on the platform of the device. In another embodiment, the strap of the belt attachment assembly may be permanently attached to the support tab assembly where the support tab assembly is attached to the support member.

In use, the belt attachment assembly is placed around the ironing board, table or the like and secured by the fastening means at a location deemed desirable by the user. A flat iron can then be placed within the frame for use. In the detachable embodiment, once the belt attachment assembly has been placed around the ironing board or table in the desired location, the mating tabs of the belt attachment assembly and support tab assembly are joined thereby securing the instant invention to the ironing board or table. A flat iron can then be placed within the frame for use.

As will be understood, the user will position the present invention in a location convenient for the type of work being done thereby minimizing lifting and moving the hot iron. Also, the shaped frame will secure the flat iron and prevent movement in either a forward or backward direction or from side to side thereby preventing the hot iron from being inadvertently knocked off the ironing board or turned over. Additionally, the dangers associated with burns will be reduced because the device will be located conveniently to the piece work and securely for the user.

DETAILED DESCRIPTION OF THE DRAWINGS

Figure 1:
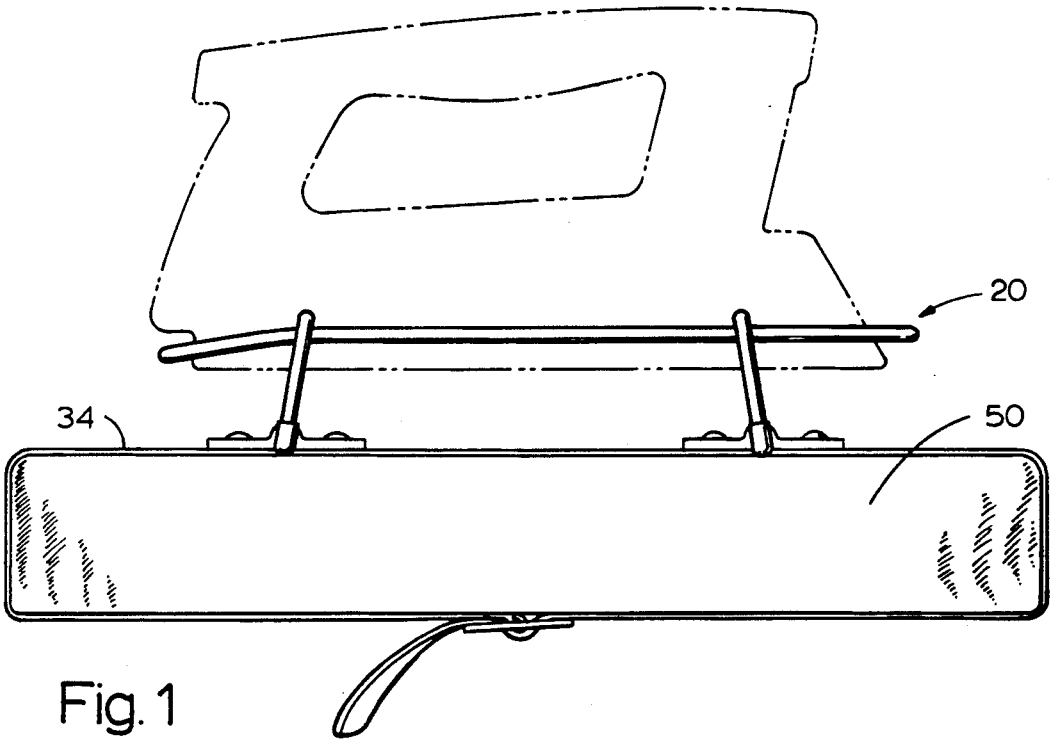
FIG. 1 is a side elevational view showing a flat iron in phantom illustrating the present invention and the attachment of the invention to the ironing board.

Referring now to the drawings wherein like reference characters represent like elements, FIG. 1 shows support 20 secured to an ironing board 50 with a flat iron in phantom.

Figure 2:
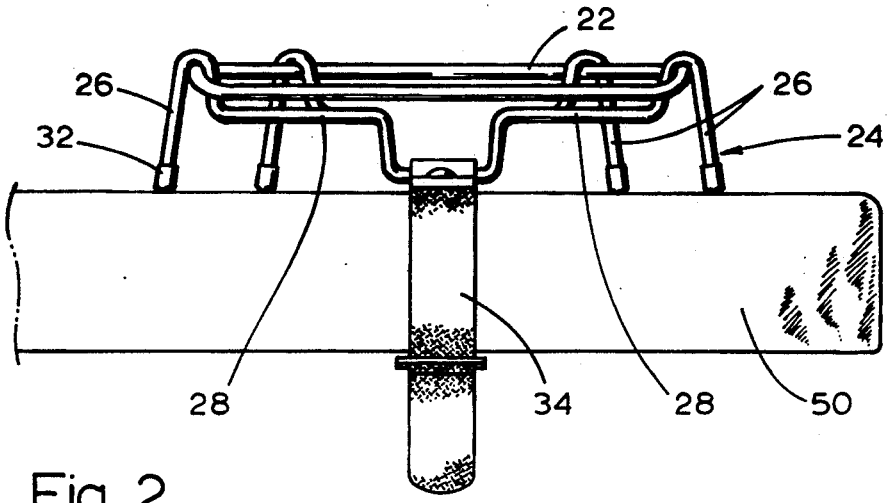
FIG. 2 is a rear view of the present invention without the flat iron in phantom.

FIG. 2 shows a rear view of the present invention secured to ironing board 50. Support member 24 is shaped such that there are two leg segments 26 between which is a straight segment 28. At a central position along straight segment 28 is a depressed section 30. In a particular embodiment, the ends of leg segments 26 are fitted with a protective foot 32. As will be seen, leg segments 26 are so sized that both straight segment 28 and depressed section 30 are elevated above the surface of ironing board 50. Leg segments 26 mate with frame 22 at the highest point of leg segments 26 and above straight segment 28. Depressed section 30 mates with strap 34 below straight segment 28. As a result of its location above straight section 28, it will be understood that frame 22 will act as a frame during use to maintain a flat iron in a fixed position.

Figure 3:
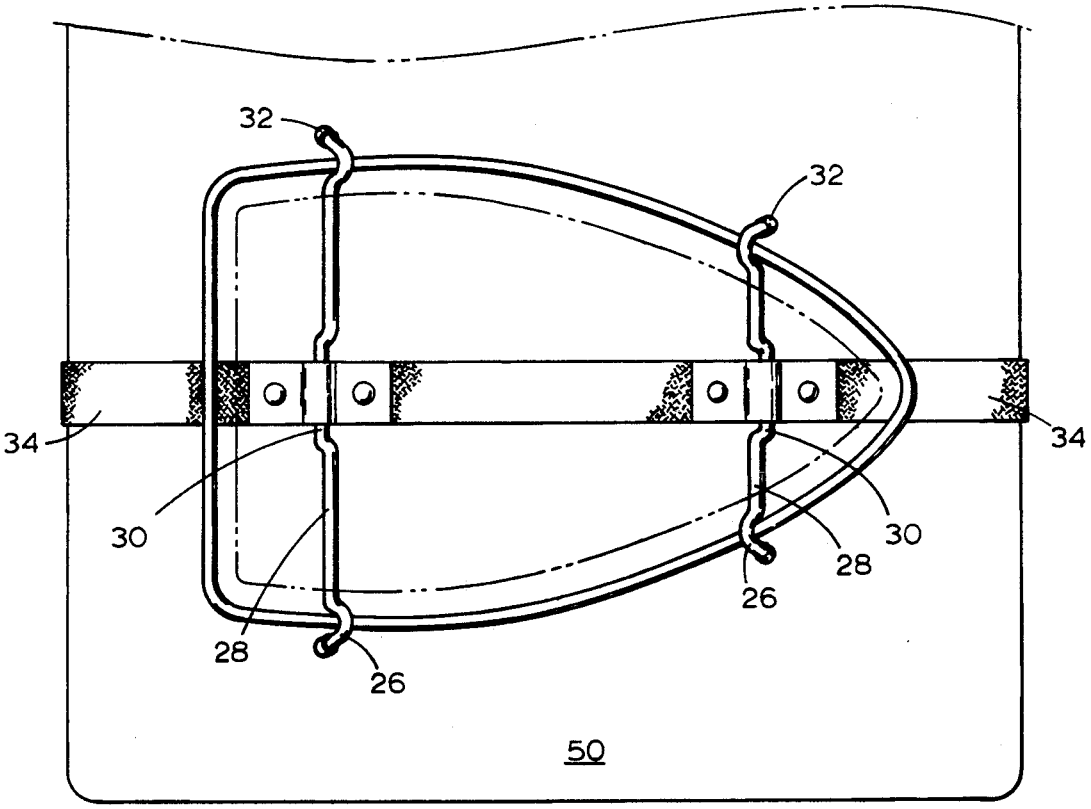
FIG. 3 is a plan view of the invention with the face of a flat iron in phantom.

FIG. 3 shows strap 34 affixed to depressed sections 30 of straight sections 28 and surrounding ironing board 50 thereby securing the present invention to the board. As will be seen, frame 22 and straight sections 28 are sized to correspond to the shape of the flat iron being used. It will be understood from the phantom of the face plate of a flat iron that the face plate rests on straight segments 28. It will be further understood that frame 22 acts as a frame to maintain the position of the flat iron when it is resting on straight segments 28.

Figure 4:
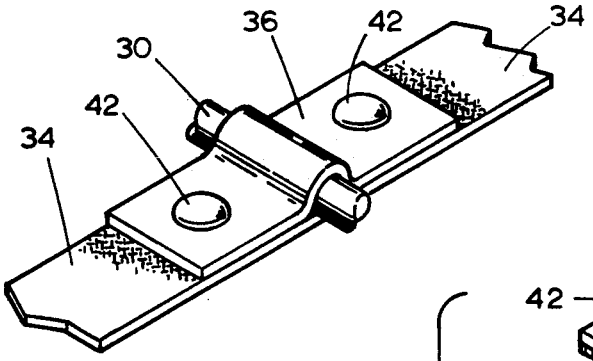
FIG. 4 is a perspective view of the optional support tab assembly.

FIG. 4 shows one method of attaching strap 34 to support member 24. Leg tab assembly 36 consists of a shaped plate. Depressed section 30 of support member 24 is centered between shaped plate 36 and strap 34 which are then joined by rivets 42. The instant invention would then be secured to ironing board 50.

Figure 5:
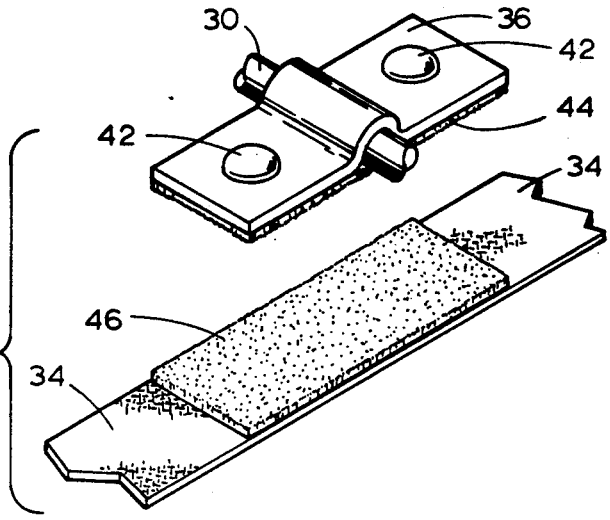
FIG. 5 is a partial perspective view of a portion of the belt assembly showing the optional mating tab.

FIG. 5 shows an optional belt attachment assembly. As in the variation shown in FIG. 4, shaped plate 36 is mated with depressed section 30 of support member 24. Instead of being riveted directly to strap 34, however, a mating tab 44 is affixed to the underside of shaped plate 36. A complimentary mating tab 46 is affixed to the upper surface of strap 34. In use, tab 46 is mated with tab 44 of shaped plate 36. As will be appreciated, the device of frame 22-support member 24 can then be easily attached or removed from strap 34 thereby facilitating convenient use of the instant invention.

As will be apparent from examination of the drawings and the accompanying description, the present invention will provide tailors, dressmakers, drycleaners, housewives and other individuals who require use of a hot iron in the course of their duties with a support which can be attached to an ironing board, table or the like at any location convenient for the user and which can be easily attached or removed from the ironing board or table. Likewise, the device is lightweight to use yet durable and economical to manufacture. Lastly since the "platform" on which the hot iron rests is of minimal size and raised above the ironing surface, the heat emanating from the hot iron will be evenly displaced thereby eliminating hot spots which could cause the piece work or the user to be burned.

As various changes could be made in the above product without departing from the scope of the invention, it is intended that all matter contained in the above description or shown in the accompanying drawings shall be interpreted as illustrative and not in a limiting sense.

What is claimed is:

1. A detachable iron support suitable for use with an ironing board, table or other surface suitable to serve as a support for ironing fabric comprising a frame, a plurality of support members wherein said frame and said support members are made from heavy gauge wire, and a belt attachment assembly wherein said frame is shaped correlatively to the face plate of an iron; and wherein said support members are shaped such that each said support member has a straight segment located between two leg segments, each of said leg segments terminating in a foot suitable for engaging the ironing board or other suitable surface, said straight segment having a depression at a central location and said leg segments being sized so that when the foot of each said leg segment is resting on said ironing board, table or other surface, said straight segment and said depression will be elevated above said ironing board, table or other surface; and wherein said frame is mated with said support members at a position along said leg segment opposite the foot of said leg segment and in such arrangement that said frame is located above said straight segment and said depression thereby creating an enclosure; and wherein said belt attachment assembly is comprised of a strap and a fastening means and is mated with each said depression of each said straight segment of each said support member so as to attach said belt attachment assembly to said support member and to facilitate attachment of said iron support to said ironing board, table or other surface.

2. A detachable iron support according to claim 1 wherein said strap of said belt attachment assembly is of sufficient length to surround said ironing board, table or other surface.

3. A detachable iron support according to claim 1 wherein said belt attachment assembly is mated with each said support member by locating the depression of each said straight segment between one of a plurality of shaped plates and said strap and permanently affixing said plurality of shaped plates to said strap.

4. A detachable iron support according to claim 1 wherein said heavy gauge wire is covered with a heat resistant material.

5. A detachable iron support according to claim 1 wherein each foot of each leg segment is covered with a protective casing.

6. A detachable iron support suitable for use with an ironing board, table or other surface suitable to serve as a support for ironing fabric comprising a frame, a plurality of support members wherein said frame and said support members are made from heavy gauge wire, and a belt attachment assembly wherein said frame is shaped correlatively to the face plate of an iron; and wherein said support members are shaped such that each said support member has a straight segment located between two leg segments, each of which leg segments terminates in a foot designed to engage an ironing board or other surface, said straight segment having a depression at a central location and said leg segments being sized so that when the foot of each said leg segment is resting on said ironing board, table or other surface, said straight segment and said depression will be elevated above said ironing board, table or other surface; and wherein said frame is mated with said support members at a position along said leg segment opposite the foot of said leg segment and in such arrangement such that said frame is located above said straight segment and said depression thereby creating an enclosure; and wherein said belt attachment assembly is comprised of a plurality of first parts, a plurality of second parts and a fastening means wherein each said first part is comprised of a shaped plate and a mating tab affixed thereon and each said second part is comprised of a corresponding mating tab affixed to the surface of said strap; and wherein each said first part and each said second part is mated with each said depression of each said straight segment of each said support member so as to facilitate attachment of said iron support to said ironing board, table or other surface.

7. A detachable iron support according to claim 6 wherein said strap of said belt attachment assembly is of sufficient length to surround said ironing board, table or other surface.

8. A detachable iron support according to claim 6 wherein said heavy gauge wire is covered with a heat resistant material.

9. A detachable iron support according to claim 6 wherein said belt attachment assembly is mated with each said depression of each said straight segment of each said support member by locating each said depression between each said first part and each said second part of said belt attachment assembly and fastening each said first part to a corresponding second part thereby semi-permanently affixing each said depression of said straight segment between each said first part and each said second part.

10. A detachable iron support according to claim 6 wherein said foot of said leg segment is covered with a protective casing.

* * * * *